166-250 SR
FIP8011 OR 4,168,747

United States Patent [19]

Youmans

[11] 4,168,747

[45] Sep. 25, 1979

[54] METHOD AND APPARATUS USING FLEXIBLE HOSE IN LOGGING HIGHLY DEVIATED OR VERY HOT EARTH BOREHOLES

[75] Inventor: Arthur H. Youmans, Houston, Tex.

[73] Assignee: Dresser Industries, Inc., Dallas, Tex.

[21] Appl. No.: 830,235

[22] Filed: Sep. 2, 1977

[51] Int. Cl.[2] ..... E21B 47/00

[52] U.S. Cl. ..... 166/250; 166/315

[58] Field of Search ..... 166/250, 311, 312, 315, 166/153, 155, 156, 251-255, 66, 113; 73/151, 152; 340/18 R; 175/61, 77, 78, 45, 50

[56] References Cited

U.S. PATENT DOCUMENTS

| | | | |
|---|---|---|---|
| 2,852,230 | 9/1958 | Garrison | 175/61 X |
| 3,394,760 | 7/1968 | Childers et al. | 166/155 |
| 3,394,760 | 7/1968 | Childers et al. | 166/315 |
| 3,401,749 | 9/1968 | Daniel | 166/155 |
| 3,467,196 | 9/1969 | Kinsman | 166/315 |
| 3,920,076 | 11/1975 | Laky | 166/135 |
| 4,064,939 | 12/1977 | Marquis | 73/151 |

*Primary Examiner*—Ernest R. Purser
*Attorney, Agent, or Firm*—Albert M. Crowder, Jr.

[57] ABSTRACT

After drilling an earth borehole, the drill pipe and drill bit are removed from the borehole and the drill pipe is reinserted into the borehole. A flexible hose such as a fire hose, and having a retro-nozzle at its lower end, is then pumped down through the interior of the drill pipe and a portion of the hose is pumped out through the end of the drill pipe for a desired distance. A well logging instrument is pumped through the flexible hose which extends down past the bottom of the drill pipe and well logging operations are performed through the flexible hose. In very hot wells, the drilling mud or other circulating fluid can continue to be pumped through the flexible hose to provide cooling of the well logging instrument.

7 Claims, 8 Drawing Figures

METHOD AND APPARATUS USING FLEXIBLE HOSE IN LOGGING HIGHLY DEVIATED OR VERY HOT EARTH BOREHOLES

BACKGROUND OF THE INVENTION

This invention relates generally to methods and apparatus for logging earth boreholes and specifically to methods and apparatus which allow the logging of highly deviated and very hot earth boreholes.

It has become relatively common within the last few years to drill wells in the search for oil and gas and the like with a portion of the bore deviating from the usual vertical orientation thereof. The deviation or inclination may extend for a considerable distance at angles ranging to 70°, sometimes returning to the usual vertical orientation. In some instances, such boreholes may even extend past 90° from the vertical and actually be extending in the upward direction for some distance.

It is also well known in the art of drilling such wells to attempt the logging of the formation surrounding such boreholes with logging instruments run into the well bore on a wireline and/or cable to perform various operations. Such tools usually depend upon the force of gravity to permit the positioning of the well tool at the desired formation in the well bore.

Manifestly, the relatively horizontal angle of the deviated portion of the well bore will not permit the wireline-actuated tools to move into the lower portion of the well bore since friction of the well tool in the deviated portions works against the force of gravity. Thus, it becomes essential to provide some means for causing a well logging instrument to pass through the deviated portions of the well bore.

Another problem associated with such boreholes relates to the instability of some formations penetrated by the well bore, thus causing borehole diameter changes, some very abrupt. Ledges are formed, and the logging instruments sometimes lodge against them.

Those skilled in the art will recognize that there have also been systems which pump well logging instruments down through the drill pipe and that only certain well logging systems, for example, those using radioactivity, can be utilized since they are effective whether within or without the drill pipe. However, other types of well logging instruments cannot be effectively utilized inside the drill pipe, for example, those using acoustic, resistivity, induction and the like measurements which are unduly influenced by the drill pipe itself.

It is therefore the primary object of the present invention to provide new and improved methods and apparatus for logging deviated boreholes in which it is difficult for the well logging instrument to transverse the borehole simply with the aid of gravity.

It is yet another object of the present invention to provide new and improved method and apparatus for logging very hot wells.

The objects of the invention are accomplished, generally, by methods and apparatus which utilize a flexible hose pumped down through the interior of the drill pipe and through which logging instruments are caused to transverse the earth formations beyond the lower end of the drill pipe.

These and other objects, features and advantages of the present invention will be apparent from the following detailed description taken with reference to the figures of the accompanying drawing, wherein.

Figure 1:
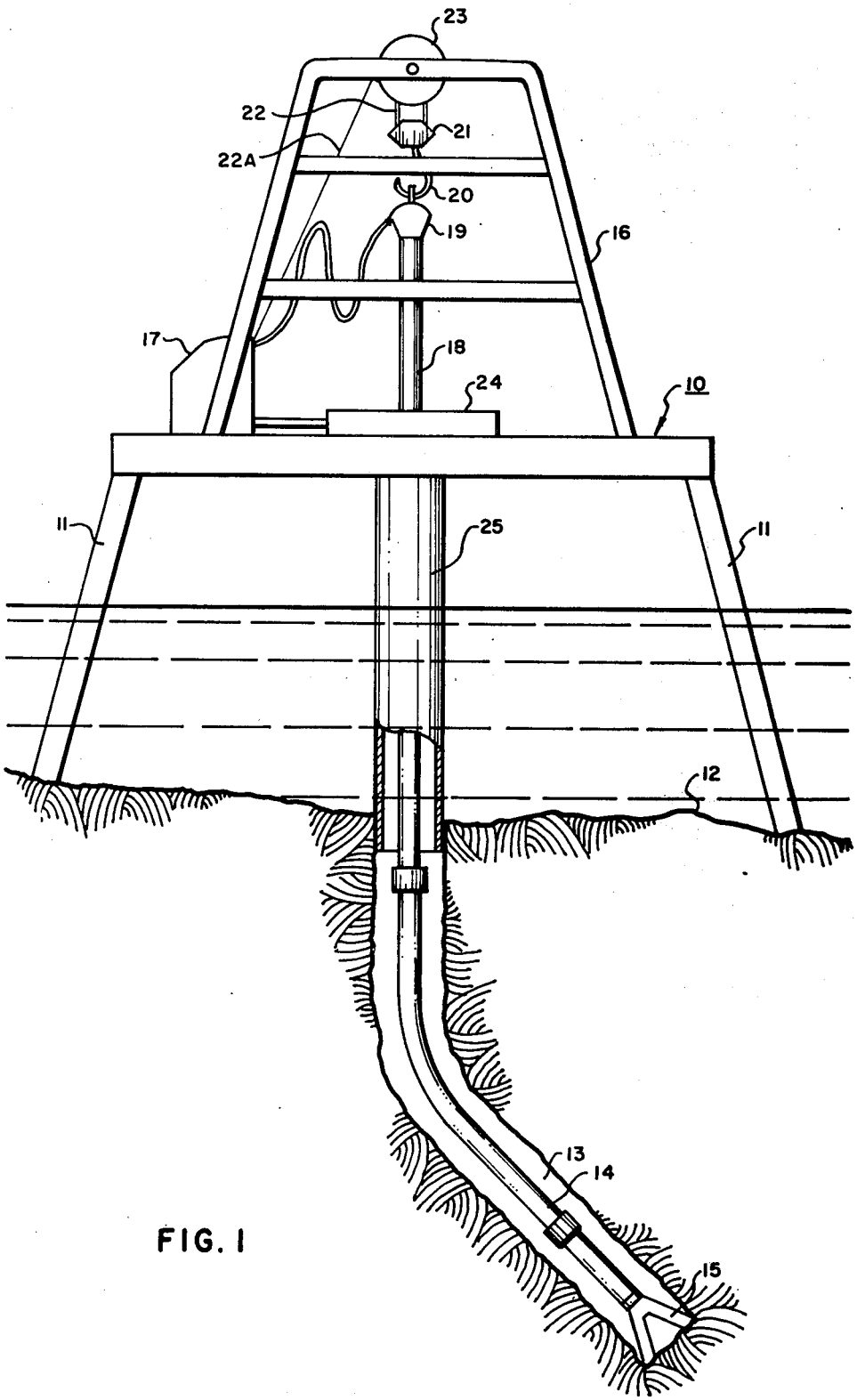
FIG. 1 is a schematic view illustrating the drilling of a deviated earth borehole from an offshore platform.

Referring now to the drawing in more detail, especially to FIG. 1, there is illustrated schematically a conventional system for drilling an earth borehole having a high degree of deviation from true vertical. As is well known in the art, it is common practice to drill such slanted wells from offshore platforms. A drilling platform 10 having a plurality of legs 11 anchored on the ocean floor 12 has an earth borehole 13 drilled therefrom. Within the borehole 13 is a pipe string 14, to the lower end of which is attached a drill bit 15. A surface casing 25 maintains the integrity of the borehole 13 as is well known in the art. A derrick 16 with its conventional drawworks 17 is mounted on the platform 10. The drill string 14 comprises a number of joined sections of pipe terminating at its upper end in a kelly 18, followed by a swivel 19, a hook 20 and a traveling block 21 suspended by a drilling line 22 from a crown block 23. The drawbacks also drive a rotary table 24 which in turn transmits the drive to the kelly 18. One end of the line 22, namely the fast line **22*a*, is connected to the drawworks 17** which contains the motor or motors for manipulating the drill string. Although not illustrated, the other end of the drill line is secured to an anchor on the platform floor, that portion of the line extending to the anchor from the crown block being generally referred to as the dead line. Again not illustrated, such an anchor member normally would include a winding-on drum and can also, if desired, contain a dead line sensor for monitoring the weight on the bit, for example, as shown in U.S. Pat. No. 3,461,978 to F. Whittle, issued Aug. 19, 1969.

In the operation of the system according to FIG. 1, it is quite conventional in drilling wells from such offshore platforms to drill the initial portion of the well substantially along a vertical line from the platform and then to angle off in the further drilling of the well. Such wells after angling off will oftentimes be inclined at an angle of 60° to 70° from vertical. It is with these types of highly deviated wells that the problem presents itself as to providing a log of the formations surrounding the well bore.

Figure 2:
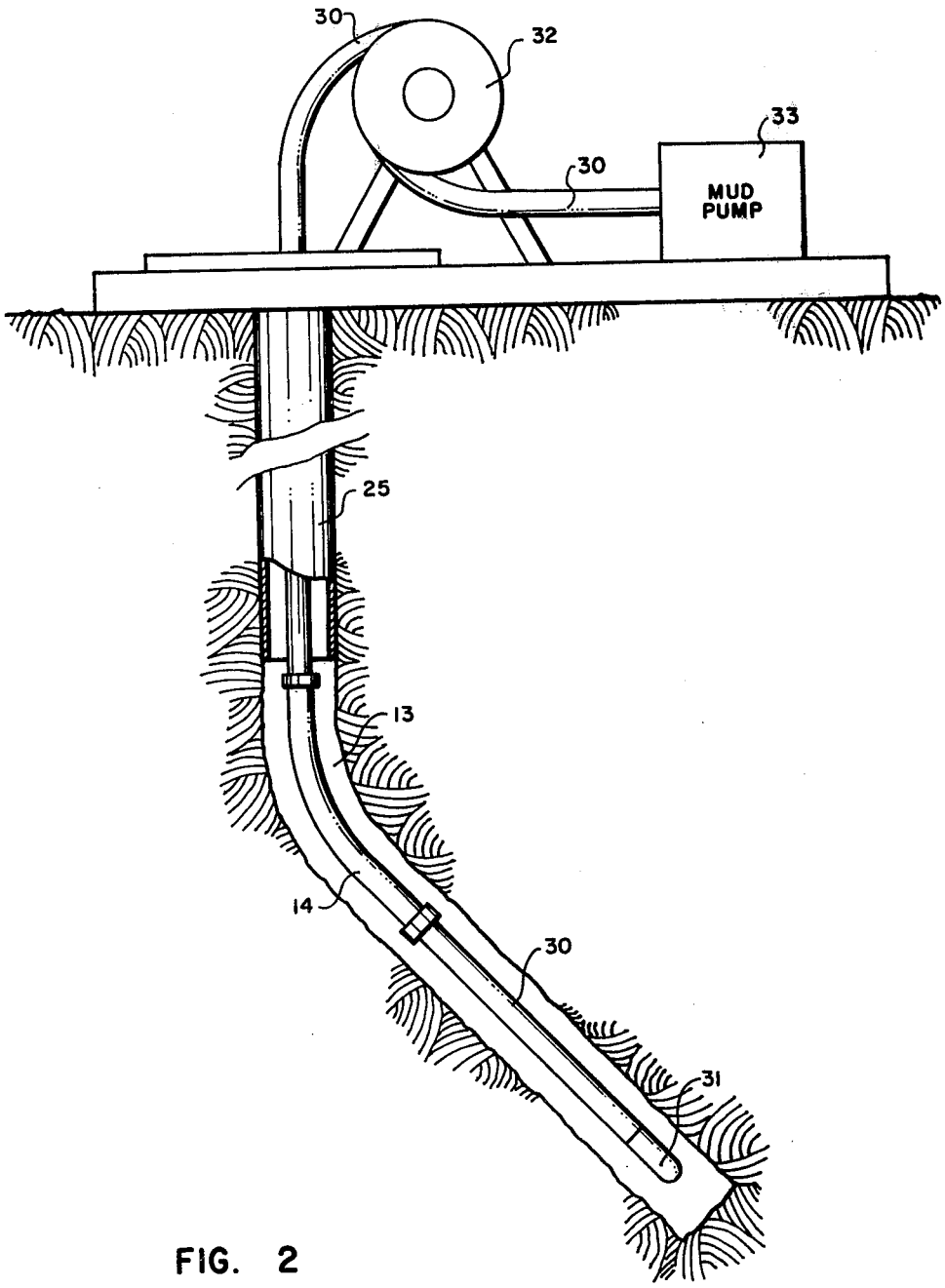
FIG. 2 is a schematic view illustrating the flexible hose being pumped down an earth borehole beyond the lower extremity of the drill pipe.

Referring now to FIG. 2, there is illustrated the pipe string 14 located within the earth borehole 13 and which extends through the surface casing 25 as is likewise illustrated in FIG. 1. However, in FIG. 2, the drill pipe 14 has been removed from the borehole and the drill bit 15 removed in order to allow the flexible hose 30 to be pumped down through the drill pipe 14 in a manner hereinafter illustrated and described. The flexible hose 30 has a retro-nozzle 31 attached at its lower end. The flexible hose 30 is wound on a rotating drum 32 at the earth 's surface. The flexible hose 30 is connected at its surface end to a mud pump 33 which, if desired, can be the same mud pump as is used to provide the circulation fluid when drilling the well.

In the operation of the apparatus illustrated in FIG. 2, it should be appreciated that the flexible hose is pumped down through the drill pipe 14 by means of the mud from the mud pump 33 being circulated through the retro-nozzle 31 which causes the nozzle 31 and the flexible hose 30 to proceed along the length of the borehole 13 after passing out through the lower end of the drill pipe 14.

Figure 3:
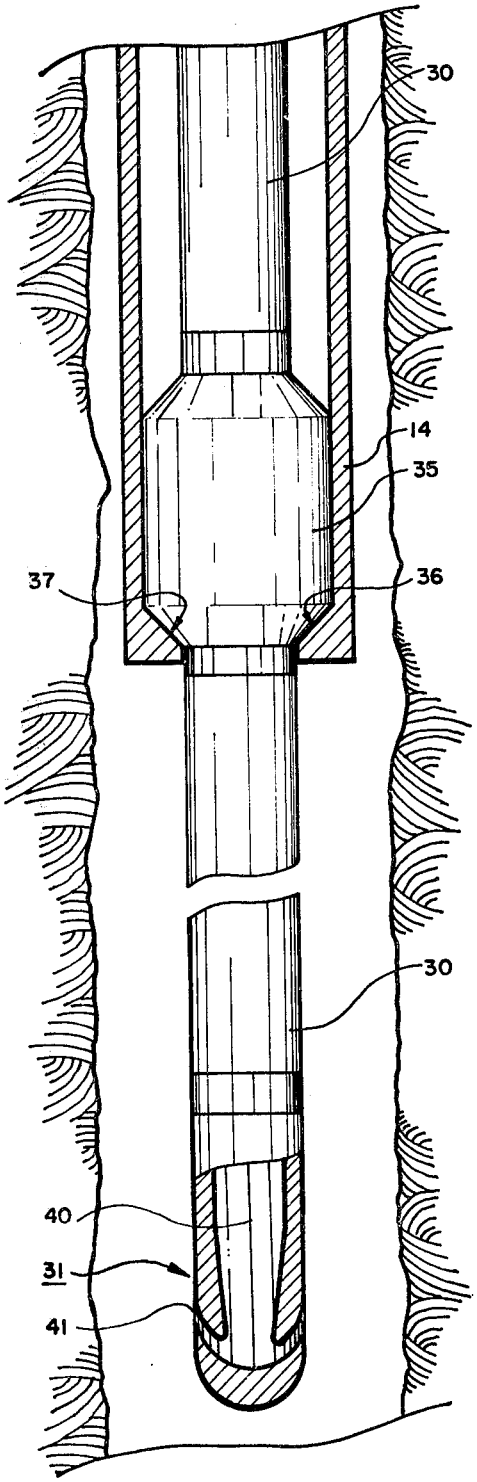
FIG. 3 is an elevated view, partly in cross section, of the nozzle and flexible hose used in conjunction with the lower end of the drill pipe in accordance with the present invention.

Referring now to FIG. 3, the retro-nozzle 31, illustrated partly in cross section, is attached to the lower end of the flexible hose 30. An intermediate portion of the flexible hose 30 has an expanded portion member 35 which has tapered surfaces 36 which are sized to mate with the tapered surfaces 37 of a seating nipple attached to the lower end of the drill pipe 14. The expanded portion member 35 has a central bore (not illustrated) which is sized to permit mud flow and the passage of the well logging instrument therethrough.

The retro-nozzle 31 likewise has a central bore 40 and nozzle jets 41 which are directed backwards toward the lower end of the drill pipe 14.

In the operation of the apparatus illustrated in FIG. 3, it should be apppreciated that before the expanded portion member 35 comes into contact with the tapered surfaces of the seating nipple, the circulating fluid or mud is being pumped down through the interior of the flexible hose 30, the central bore of member 35, through the center bore 40 of the retro-nozzle 31 and out through the jets 41 which causes the nozzle 31 and hose 30 to be pushed down and along the length of the borehole. After the expanded portion member 35 is in place against the seating nipple, circulation fluid may be continued if desired to cool the well logging instrument (not illustrated) within the interior of the flexible hose 30.

Figure 4:
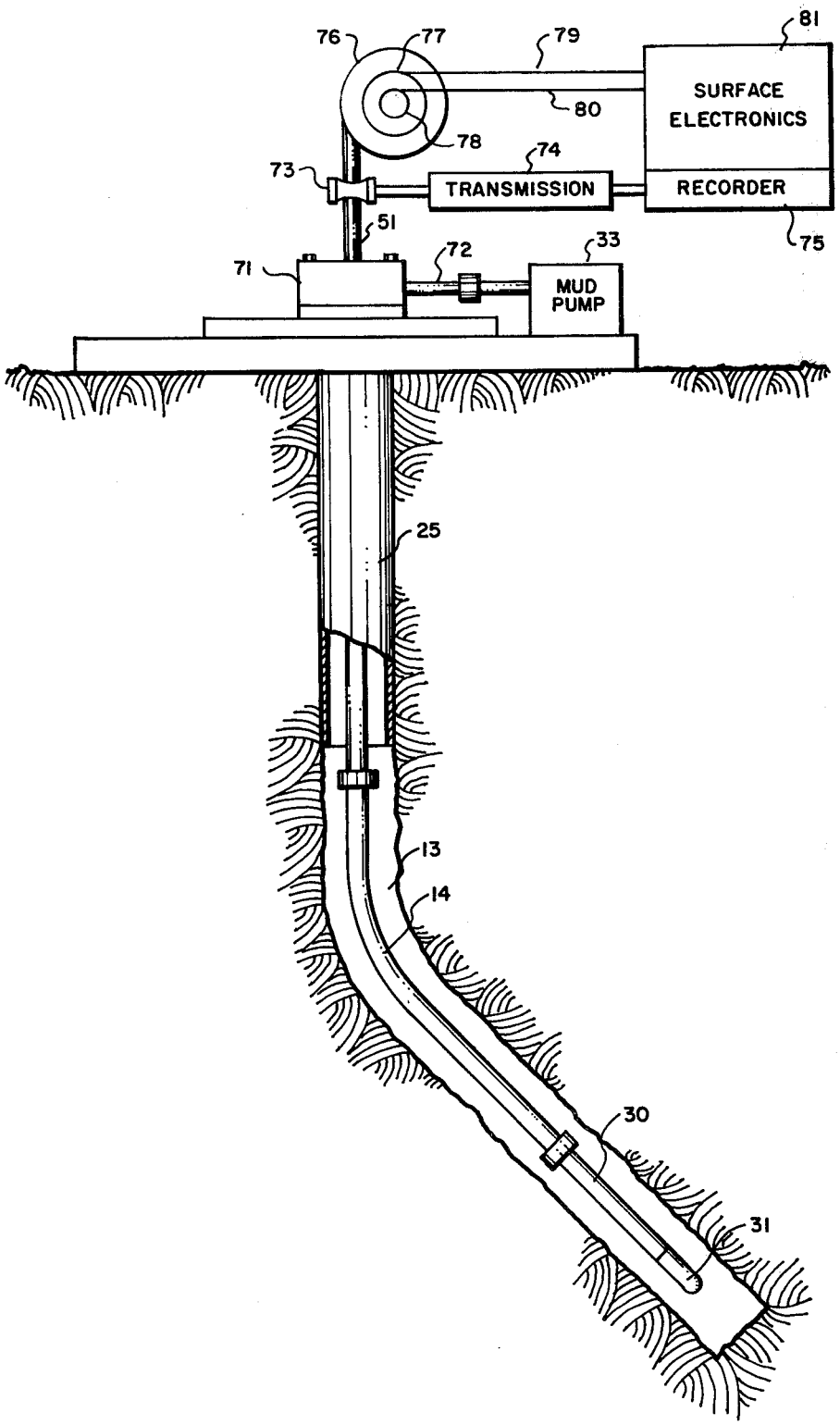
FIG. 4 is a schematic view, partly in cross section, showing the apparatus used for logging an earth borehole from the interior of a flexible hose in accordance with the present invention.

Referring now to FIG. 4, the upper portion of the flexible hose 30 is terminated in an assembly 71 having an outlet 72 to which the mud pump 33 is connected. The assembly 71 is illustrated in greater detail in FIGS. 7A and 7B hereinafter. The logging cable 51 is attached to a well logging instrument within the hose 30 and passes over the measuring sheave 73 which, through a transmission 74, drives a recorder 75 so the well logging data is recorded in synchronization with the depth of the well logging instrument within the borehole. The well logging cable 51 passes over a rotating drum 76 having slip rings 77 and 78 which allow electrical signals to be passed over the conductors 79 and 80 from the well logging cable 51 to the surface electronics 81. In a manner well known in the art, the well logging instrument within the hose 30 is thus caused to traverse the borehole 13 and log the various parameters of interest relating to the earth formations surrounding the borehole 13.

Figure 5:
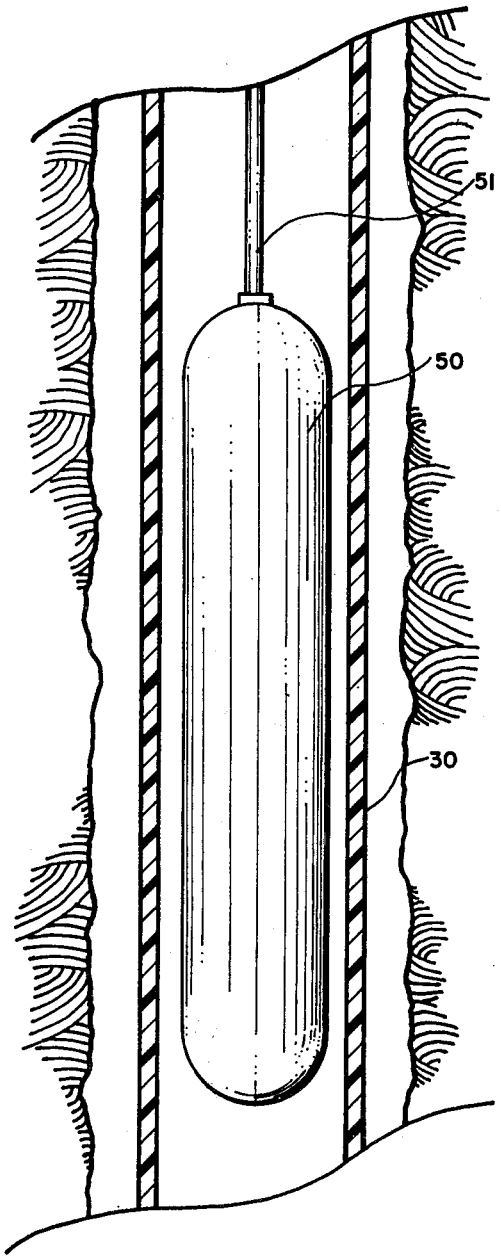
FIG. 5 is a schematic view, partly in cross section, illustrating a well logging instrument within the interior of a flexible hose in accordance with the present invention.

FIG. 5 illustrates a conventional well logging instrument 50 suspended by a logging cable 51 from the earth's surface and which causes the well logging instrument 50 to traverse the interior of the flexible tubing 30. Assuming that there is to be no pumpdown operation of the well logging instrument 50 such as is illustrated in FIG. 6 hereinafter, the well logging instrument 50 is sized such that it can traverse the interior of the flexible tubing 30.

Figure 6:
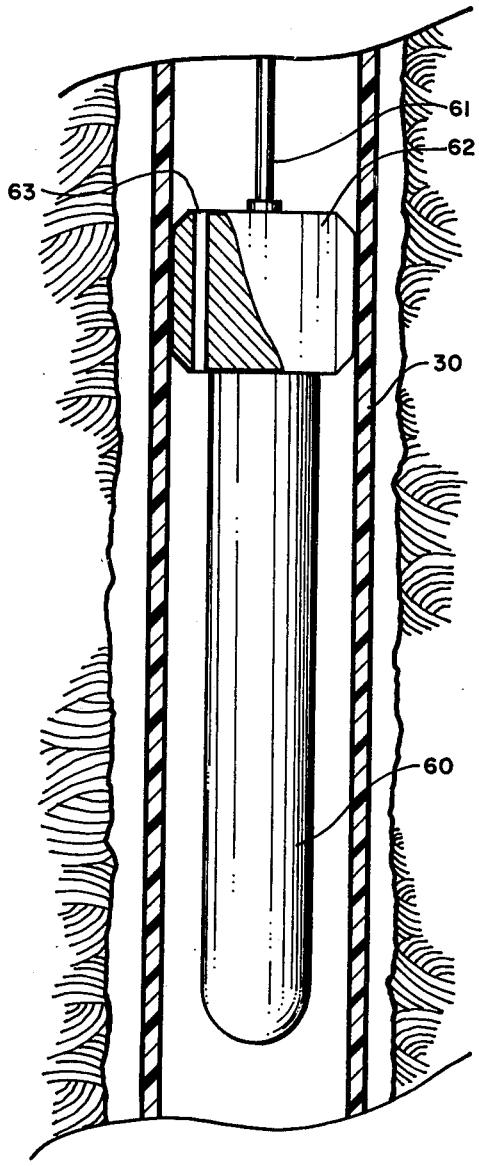
FIG. 6 is a schematic view, partly in cross section, illustrating an alternative embodiment of a well logging instrument within the interior of a flexible hose in accordance with the present invention.

Referring now to FIG. 6, there is illustrated a conventional well logging apparatus 60 which is hoisted by a well logging cable 61 from the earth's surface and which is caused to traverse the interior of the flexible hose 30. The well logging instrument 60 includes a conventional pumpdown sub 62 which is sized to closely approximate the internal dimensions of the flexible hose 30 and which has a by-pass port 63 therethrough which allows the drilling fluid to "pump down" the well logging instrument 60 in traversing the interior of the flexible hose 30.

Figure 7A:
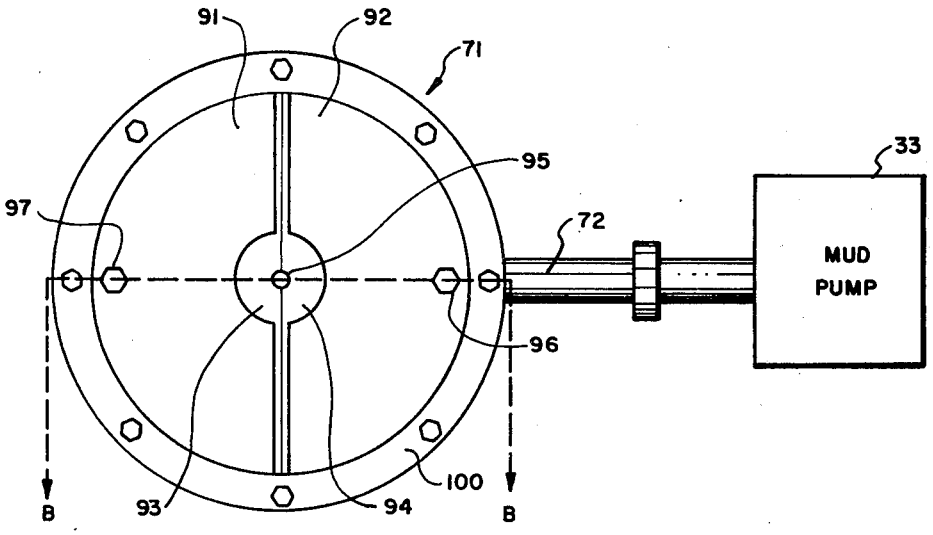
FIG. 7A illustrates a top plan view of an apparatus used in accordance with the present invention for pumping mud through the interior of the flexible hose in accordance with the present invention.

Referring now to FIG. 7A, the apparatus 71 illustrated in FIG. 4 is shown in greater detail. The uppermost portion of the cylindrical shaped apparatus 71 is comprised of two parts, shown generally by the numerals 91 and 92. Portion 91 has rubber or other packing material 83 along its inner periphery and the portion 92 has rubber packing material 94 along its inner periphery. The center portions of the packing material 93 and 94 form a circular insert having a center orifice 95 through which the logging cable 51 can move while effecting a seal therebetween. A pair of bolts 96 and 97 are utilized to hold the upper two portions 91 and 92 against each other and against the lower portion 98 illustrated in FIG. 7B.

Figure 7B:
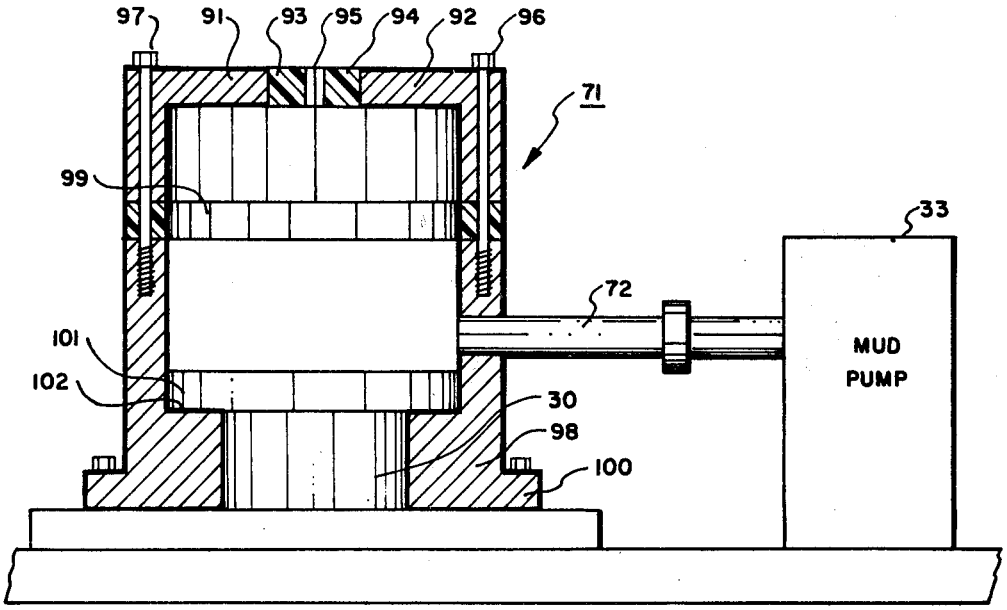
FIG. 7B illustrates, partly in cross section, an elevated view of the apparatus illustrated in FIG. 7A.

FIG. 7B, partially shown in cross section, is takenn along the section lines B—B of FIG. 7A. Packing material 99 is used to effect a seal between the members 91 and 92 and the lower member 98. The lower portion of the apparatus 98 has an outer ring 100 which bolts the overall assembly to the floor of the rig. A flexible hose 30 having an upper expanded portion 101 is shown in place within the apparatus 71 resting against a retaining ledge 102 formed within the lower member 98.

In assembling the apparatus shown in FIGS. 7A and 7B, the mud from the mud pump 33 is used to pump the flexible hose 30 and its nozzle 31 down the length of the borehole until the expanded portion 101 comes to rest against ledge 102 and the expanded portion member 35 illustrated in FIG. 3 comes to rest against the seating nipple at the lower end off the drill pipe. After this occurs, the well logging instrument is lowered into the interior of the upper end of the flexible tubing 30 and the upper portions 91 and 92 of the assembly 71 are bolted in place around the logging cable 51 and there is thus effected a fluid-tight seal whereby mud can then be pumped from the mud pump 33 through the flexible tubing 30 to effect cooling of the well logging instrument if desired and also to facilitate pumping of the well logging instrument through the hose 30.

Although not illustrated in FIGS. 7A and 7B, the lower portion 89 of the apparatus 71 can be made to be adjustable with relation to the rig floor to facilitate the upper portion 101 of the hose 30 resting against the ledge 102 in conjunction with the expanded portion member 35 resting against the seating nipple at the lower end of the drill pipe. As an alternative embodiment of the present invention, all of the hose 30 above the expanded portion member 35 as illustrated in FIG. 3 can be eliminated. With such an embodiment, the well logging instrument is either lowered by gravity or pumped down until it enters the expanded portion member 35 and then passes into the flexible hose 30.

It should be appreciated that the flexible hose 30 can take various forms which may have various mechanical and electrical properties. The preferred embodiment contemplates that the nose 30 will be very similar to the common fire hose used by fire departments. It should be appreciated that such hoses are collapsible and are easily wound upon the drum 32 in FIG. 2 when not filled with fluid. They should ordinarily have fairly high tensile strength and may be fabricated from high temperature polymers if the system is to be used in conjunction with the logging of very hot wells, for example, geothermal wells. Furthermore, the hose to be used may be electrically conductive if desired, may be a collapsible woven fabric, plastic, buoyant, or may come in various other forms.

Reviewing again the theory behind the present invention, it should be appreciated that the logging of highly deviated earth boreholes by pumping well logging instruments out the end of the drill pipe is not always satisfactory because the interval which can be logged by such a method is at best unpredictable and at worst is prohibitively small. Thus the need has arisen to provide well logging methods and apparatus which can assure that on each round trip there will be a preplanned interval logged and that any desired size interval up to the total well depth can be logged. The method and apparatus described herein is a departure from the more straight-forward pumpdown systems such as those which can be used with nuclear or radioactivity devices with the drill pipe extending all the way to the bottom of the earth borehole. Clearly, with the prior art methods, the instrument can be pumped to the end of the tubing string or drill pipe but no further.

Consequently, the present invention provides an extension to the drill pipe through which most types of logs can be run. For example, the present invention contemplates that induction, resistivity, acoustic and the like well logging systems can be used in addition to the radioactivity devices. Furthermore, the preferred embodiment contemplates that a flexible, collapsible woven fabric hose similar to a fire hose is used to enable the hose to be wound on a simple reel.

In reviewing the overall operation of the system herein described, a long piece of woven fabric with sufficient electrical and mechanical properties, sufficient strength, desirable buoyancy properties and appropriate diameter is provided. The hose is fitted at its lower end with a pressure-actuated retro-nozzle to direct the emitted fluid backward. When the mud or other circulation fluid is pumped into the hose, it becomes stiffer with increasing pressure. With the nozzle at its nose, such a distended hose can be pumped into a crooked inclined hole and a logging instrument can be pumped through it. Depending on its construction, it will permit various logs, for example, acoustic and resistivity, to be run on the way in and/or on the way out of the hole.

As a first illustration of the utility of the present system, consider first the use of the hose with no portion of the hose extending above the expanded portion member 35. A given length of hose, for example, 1,000 to 2,000 feet long, is fitted with the retro-nozzle at the far end and with the expanded portion member and the seating nipple at the near end, all designed to travel through a drill string and come to a stop when the seating nipple reaches the end of the drill pipe. The hose can then be taken to a test well and lowered into the well, under gravity or whatever, and into the hose is dropped a sinker bar on a long sandline. After the sinker bar reaches the nozzle, the hose and sandline can be wound in together. The reel is then taken to the earth borehole to be logged, along with a conventional logging unit and one or more well logging instruments which are sized to travel through the interior of the flexible hose. To complete the example, assume that in the well to be logged, there is 9,000 feet of drill pipe which terminates 1,000 feet off the bottom of the well. 1,000 feet of flexible hose is then lowered through the drill pipe including the sinker bar towing its sandline. As the hose disappears into the drill pipe, its progress is monitored by reading an odometer as the sandline is unreeled. Should the sandline stop, the mud pump will force it on to total depth. With the seating nipple engaged at the bottom of the drill pipe, mud circulation can only take place down through the hose and out the retro-nozzle. While thus circulating, the sinker bar is withdrawn and a logging instrument on a conventional logging cable is caused to traverse the interior of the flexible hose and well logging measurements thus made. When the well logging operation is completed, the hose can be retrieved by the well logging instrument itself or by a fishing latch on the sandline or can be brought up as the drill pipe is removed from the well bore, It should be appreciated that the method and apparatus described herein provides for fluid to circulate past the well logging instrument at all times if desired. This enables very hot wells, whether or not highly deviated, to be logged because of the logging instrument being cooled below ambient temperature during logging operations.

Thus there have been illustrated and described herein the preferred embodiments of the present invention which enable highly deviated and very hot wells to be logged. However, obvious modifications to these embodiments will occur to those skilled in the art. For example, if desired, the well logging instrument can be caused to pass out through the end of the flexible hose by fracturing or dislodging the retro-nozzle to enable the well logging instrument to lie up against the borehole wall rather than being confined to the interior of the flexible hose. Likewise, instead of pumping the hose through the string of drill pipe, the invention also contemplates a system wherein the flexible hose is pumped through other forms of metal conduits, for example, through tubing.

The embodiments of the invention in which an exclusive property or privilege is claimed are defined as follows:

1. A system for logging the formations surrounding an earth borehole, comprising:

a string of drill pipe positioned within an earth borehole extending from the earth's surface to a point in the borehole positioning a lower extremity of said drill pipe intermediate the earth's surface and the bottom of said borehole;

a seating nipple having an internal tapered surface attached to said lower extremity of said drill pipe;

a length of flexible, high-temperature hose having a retro-nozzle at its one end and an expanded portion member forming a tapered surface sized to mate with said internal tapered surface of said seating nipple at its second end;

means at the earth surface for pumping fluid through said hose and said nozzle to thereby move said hose through said drill pipe and out through said lower extremity of said drill pipe until said tapered surface engages said seating nipple at said lower extremity of said drill pipe;

means for causing a well logging instrument to traverse the interior of said flexible hose for providing indications functionally related to the subsurface formations surrounding said flexible hose; and means at the earth surface for pumping a fluid through said flexible hose while said logging instrument is caused to traverse the interior of said flexible hose for providing a continuous cooling of said logging instrument.

2. The system according to claim 1 wherein said flexible hose is comprised of a collapsible woven fabric material.

3. A system for logging the formations surrounding an earth borehole, comprising:

a string of metal conduit positioned within an earth borehole extending from the earth's surface to a point in the borehole positioning a lower extremity of said conduit intermediate the earth's surface and the bottom of said borehole;

a length of flexible, high-temperature hose;

means at the earth surface for pumping fluid through said hose to thereby move said hose through said conduit and out through said lower extremity of said conduit until said hose is positioned outside of said conduit and within the earth borehole with one hose extremity connected to said lower extremity of said conduit;

means for causing a well logging instrument of a type designed for operation within a non-metallic casing to traverse the interior of said flexible hose; and means for causing a continuous flow of fluid through said hose during said logging instrument traverse thereof for cooling said logging instrument.

4. The system according to claim 3 wherein said flexible hose is comprised of a collapsible woven fabric material.

5. A method for logging the formations surrounding an earth borehole, comprising:

running a string of drill pipe into an earth borehole;

positioning a lower extremity of said drill pipe at a point in the borehole intermediate the earth's surface and the bottom of the borehole;

pumping a length of flexible, high-temperature hose through said drill pipe and out said lower extremity of said drill pipe;

engaging one extremity of said hose with said lower extremity of said drill pipe;

causing a well logging instrument to traverse at least a portion of said flexible hose;

pumping a cooling fluid through said flexible hose while said well logging instrument is within the interior of said hose; and transmitting signals to a surface location functionally related to geological characteristics of said earth formations.

6. A method for logging the formations surrounding an elevated temperature earth borehole, comprising:

pumping a length of high-temperature, flexible hose through a metal conduit in said borehole and out through an extremity of said metal conduit to position said length of hose between said lower extremity of said conduit and the bottom of said borehole;

causing a well logging instrument to traverse at least a portion of said flexible hose thereby performing said logging of the formations surrounding said flexible hose; and circulating fluid through said flexible hose while said logging is being performed to provide cooling of said logging instrument.

7. The method according to claim 6 wherein said flexible hose is comprised of a collapsible woven fabric material.

* * * * *